US006642777B2

(12) United States Patent
Scoones

(10) Patent No.: US 6,642,777 B2
(45) Date of Patent: Nov. 4, 2003

(54) VOLTAGE REFERENCE CIRCUIT WITH INCREASED INTRINSIC ACCURACY

(75) Inventor: Kevin Scoones, Munich (DE)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/189,845

(22) Filed: Jul. 5, 2002

(65) Prior Publication Data

US 2003/0058031 A1 Mar. 27, 2003

Related U.S. Application Data

(60) Provisional application No. 60/303,264, filed on Jul. 5, 2001.

(30) Foreign Application Priority Data

Nov. 20, 2001 (DE) ..... 101 56 812

(51) Int. Cl.[7] ..... G05F 1/10
(52) U.S. Cl. ..... 327/539

(58) Field of Search ..... 327/530, 534, 327/535, 537, 538, 539, 540, 541

(56) References Cited

U.S. PATENT DOCUMENTS 5,834,926 A * 11/1998 Kadanka ..... 323/313
6,121,824 A * 9/2000 Opris ..... 327/539
6,172,555 B1 * 1/2001 Gusinov ..... 327/539

* cited by examiner

*Primary Examiner*—Jeffrey Zweizig
(74) *Attorney, Agent, or Firm*—W. Daniel Swayze, Jr.; W. James Brady; Frederick J. Telecky, Jr.

(57) ABSTRACT

The invention relates to bandgap reference voltage generator circuit including a first bipolar transistor and a second bipolar transistor, a first resistor connected so that the voltage drop across it corresponds to the difference between the base/emitter voltages of the two bipolar transistors, and which is located in the collector current path of the second transistor, and a second resistor located in the collector current path of both transistors.

6 Claims, 2 Drawing Sheets

VOLTAGE REFERENCE CIRCUIT WITH INCREASED INTRINSIC ACCURACY

This application claims priority under 35 USC §119(e) (1) of provisional application Serial No. 60/303,264, filed Jul. 5, 2001 and German application No. 101 56 812.6 filed Nov. 20, 2001.

BACKGROUND OF THE INVENTION

Such bandgap reference voltage generator circuits serving to generate a reference voltage which is practically independent of temperature for a (especially as compared to Zener diodes) relatively low supply voltage are based on the fact that with increasing temperature the base/emitter voltage of a bipolar transistor falls, whilst the difference in the base/emitter voltages of two bipolar transistors, whose current densities relate to each other in a fixed predefined ratio, increases with rising temperature. When the sum of these two voltages, depending on the temperature in opposite directions, corresponds to the bandgap of the semiconductor, e.g. around 1.205 V for silicon, it represents a reference voltage which is practically independent of temperature. This is why these circuits are also simply termed bandgap references.

A bandgap reference voltage generator circuit of the aforementioned kind is described e.g. by A. Paul Brokaw in the paper "A Simple Three-Terminal IC Bandgap Reference" in IEEE Journal of Solid-State Circuits, Vol. SC-9, No. 6, December 1974.

In the bandgap reference voltage generator circuit as shown in FIG. 2 representing that of the cited paper and which is shown in FIG. 1 as described in the present invention, the control means consist of an operational amplifier, the one input of which is connected to the collector of the first transistor whilst its other input is connected to the collector of the second transistor and whose output is connected to the bases of both transistors.

In a further embodiment of the bandgap reference as shown in FIG. 3 of the cited paper the control means consist of a current mirror, the one current branch of which is connected to the collector of the first transistor and whose other current branch is connected to the collector of the second transistor, and a further transistor whose one control input is connected to the collector of the second transistor and whose current path is connected to the bases of both transistors. One such circuit is also shown in FIG. 2 of the present description.

In the two embodiments as shown in FIGS. 2 and 3 of the cited paper and FIGS. 1 and 2 of the present description the first resistor is connected between the two emitters of the two bipolar transistors and is, in addition, located in the collector current path of the first bipolar transistor.

In the two prior art band pass references fabricated as a rule integrated, complicated tuning procedures are needed, as a rule, to compensate the production errors and tolerances of the components employed; it often being the case, namely, that fabricating the integrated circuit results in a mismatch between the circuit components employed. This may be e.g. a mismatch between the two current mirror transistors in the embodiment as shown in FIG. 3 (or in FIG. 2 of the Figures belonging to the present description) of the aforementioned paper. In the embodiment as shown in FIG. 2 of the aforementioned paper offsets of the input currents of the operational amplifier may occur caused by errors and tolerances in the components of the operational amplifier. It will readily be appreciated that such faults are particularly serious in a circuit whose task it is to generate a reference voltage for other circuits and are capable of substantially decrementing proper functioning of the circuit.

SUMMARY OF THE INVENTION

It is thus the objective of the invention to provide a bandgap reference voltage generator circuit of the aforementioned kind which is more immune to production errors in the components and in which the tuning procedures employed hitherto for correcting component errors are now simplified or even eliminated.

This objective is achieved by a bandgap reference voltage generator circuit of the aforementioned kind in which the first resistor is connected between the base terminals of the two transistors and is, in addition, connected to the collector of the second transistor.

BRIEF DESCRIPTION OF THE DRAWINGS

The invention will now be detailed by way of a preferred embodiment of the bandgap reference voltage generator circuit in accordance with the invention with reference to the drawings in which:

FIGS. 1 and 2 show a first and second prior art bandgap reference voltage generator circuit, both as explained in the background description; and FIG. 3 shows a preferred embodiment of a bandgap reference voltage generator circuit in accordance with the invention.

DETAILED DESCRIPTION OF THE DRAWINGS

Figure 3:
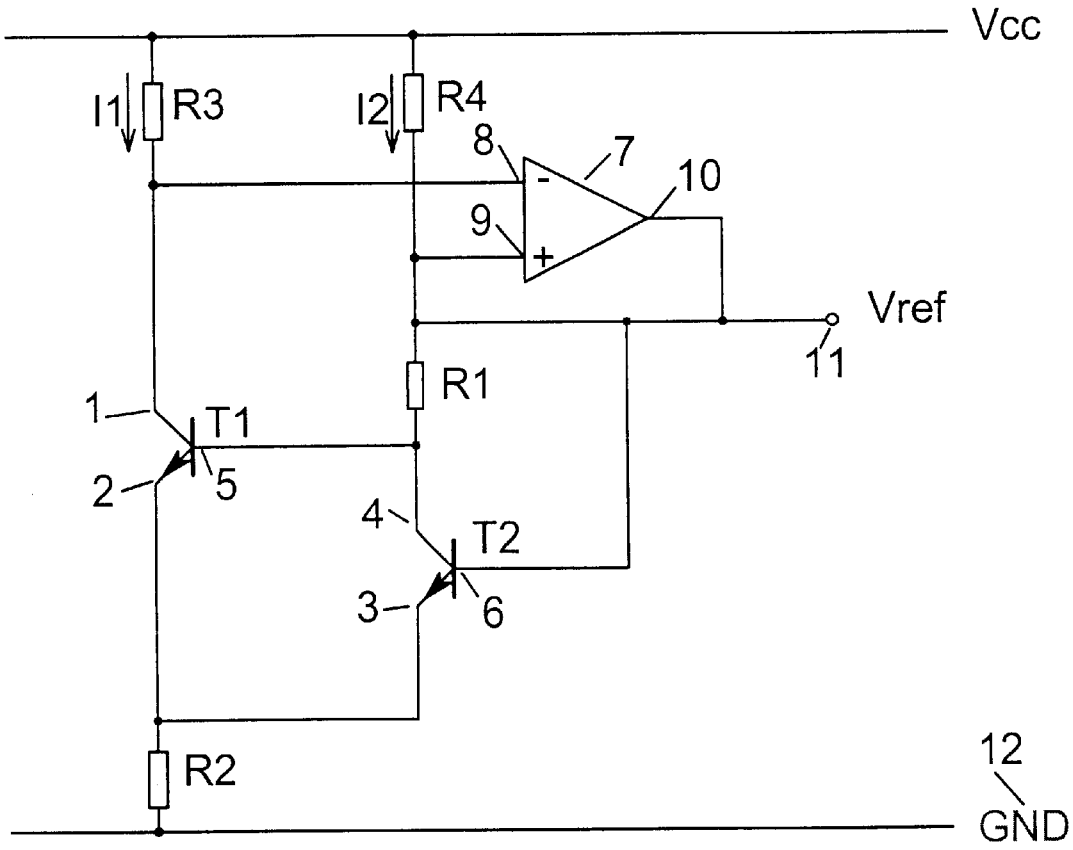
FIG. 3 is a circuit diagram of a preferred embodiment of the bandgap reference voltage generator circuit in accordance with the invention.

Referring now to FIG. 3 there is illustrated the bandgap reference voltage generator circuit including a first bipolar transistor T1, whose collector 1 is connected to a supply voltage VCC and whose emitter 2 is connected via a resistor R2 (second resistor) to a ground terminal 12. In addition, this circuit comprises a second bipolar transistor T2 whose emitter 3 is likewise connected via the resistor R2 to ground 12.

The two base terminals 5 and 6 of the two bipolar transistors T1 and T2 respectively are connected to each other via the first resistor R1.

In addition, an operational amplifier 7 is provided whose first input 8 is connected to the collector 1 of the bipolar transistor T1 while the other input 9 of the operational amplifier 7 is connected via the first resistor R1 to the collector 4 of the second bipolar transistor T2. The output 10 of the operational amplifier is connected via the first resistor R1 to the base terminal 5 of the first bipolar transistor T1 and, in addition, directly to the base terminal 6 of the second bipolar transistor T2. Two resistors R3 and R4 are furthermore provided located between the supply voltage VCC and each of the inputs 8 and 9 respectively of the operational amplifier 7. In the present example it is assumed R3=R4.

The advantages of the circuit in accordance with the invention as shown in FIG. 3 will be appreciated when considering the response to unwanted differences between the currents flowing in the two transistor current branches I1 and I2 which e.g. due to offsetting the input current of the operational amplifier employed.

The enhanced immunity of the circuit in accordance with the invention as shown in FIG. 3 to such current densities ΔI is achieved in that, the first resistor R1 in the bandgap reference voltage generator circuit is connected between the base terminals of the two bipolar transistors and is, in addition, connected to the collector of the second transistor.

An example will now be described, demonstrating that the bandgap reference voltage generator circuit as shown in FIG. 3 has a substantially higher immunity to production errors in the components used, thus saving time and costs since tuning can now be eliminated.

In the following, ΔI represents the unwanted differences between the currents I1 and I2 prompted e.g. by production errors in the components etc. (see FIG. 3) as may materialize e.g. due to the input current offset of the operational amplifier used or due to mismatch between the transistors of a current mirror.

First, the errors in the reference voltage Vref generated at the output of the prior art bandgap reference voltage generator circuit are calculated and termed ΔVref.

An error ΔVref in the reference voltage Vref materializes from the sum of the errors in the base/emitter voltage at the bipolar transistor T2 and of the voltage drop across the resistor R2 as given by the following equation 1:

$$\Delta Vref = \Delta V_{BE(T2)} + \Delta V_{R2} \quad (1),$$

where:

ΔVref: reference voltage $\Delta V_{BE(T2)}$: base/emitter voltage at bipolar transistor T2

$\Delta V_{R2}$: voltage drop across resistor R2.

The error in the base/emitter voltage at the second transistor T2 is given by the following equation 2:

$$\Delta V_{BE(T2)} = \Delta I \cdot R1 \cdot \frac{(1 + 1nA)}{1nA}, \quad (2)$$

where:

R1: resistance of the first resistor R1 and

A: the ratio of the emitter surface area of the first bipolar transistor T1 to that of the second bipolar transistor T2 (in the present example T1 has the emitter surface area A and T2 the emitter surface area 1).

The error resulting from the current error ΔI in the voltage drop across the resistor R2 is given by the following equation 3:

$$\Delta V_{R2} = \Delta I \cdot R2 \cdot \frac{(2 + 1nA)}{1nA}, \quad (3)$$

where:

R2: resistance of the second resistor R2. The current flowing through the first bipolar transistor T1 is given by the following equation 4:

$$I_{T1} = V_T \cdot \frac{1nA}{R1}, \quad (4)$$

where:

VT: is the temperature voltage as given by the following equation 5:

$$V_T = \frac{K \cdot T}{q}, \quad (5)$$

where:

q=1.602.10$^{-19}$ As (elementary charge), k=1.38.10$^{-23}$ VA/K (Boltzmann's constant) and T=absolute temperature.

From equations 1 to 4 the error in the reference voltage is then given by the following equation 6:

$$\Delta Vref = \frac{\Delta I}{I_{T1}} \cdot V_T \cdot \left[\frac{(1 + 1nA)}{InA} + (2 + 1nA) \cdot \frac{R1}{R2}\right]. \quad (6)$$

In the bandgap reference voltage generator circuit in accordance with the invention the error prompted by the current error ΔI in the base/emitter voltage of the bipolar transistor is given by the following equation (2)':

$$\Delta V_{BE(T2)} = \Delta I \cdot \frac{R1}{(1nA)^2} \quad (2)'$$

The equation for the error in the voltage drop resulting from ΔI is given by:

$$\Delta V_{R2} = \Delta I \cdot R2 \cdot \frac{(2 - 1nA)}{1nA}. \quad (3)'$$

Combining equations 1, 2', 3' and 4 thus results in the error in the reference voltage produced at the output of the voltage gives the following equation $$\Delta Vref = \frac{\Delta I}{I_{T1}} V_T \cdot \left[\frac{1}{1nA} + (2 - 1nA) \cdot \frac{R2}{R1}\right]. \quad (6)'$$

In the equation (6)' there is now the possibility of substantially reducing the effect of the current errors ΔI on the errors in the dVref by the term preceded by the minus sign, as compared to equation (6), as becomes clearly evident from the following example:

Assuming A=8, R1=54 kΩ, $I_{T1}$=1 μa, R2=324 kΩ, $V_T$=25.85 mV and T=27° C. and $\Delta I/I_{T1}$=1% the results are as follows:

| | Prior Art (FIG. 1) | Inventive circuit (FIG. 3) |
|---|---|---|
| ΔVref | 6.7 mV | 1 μV |

Figure 1:
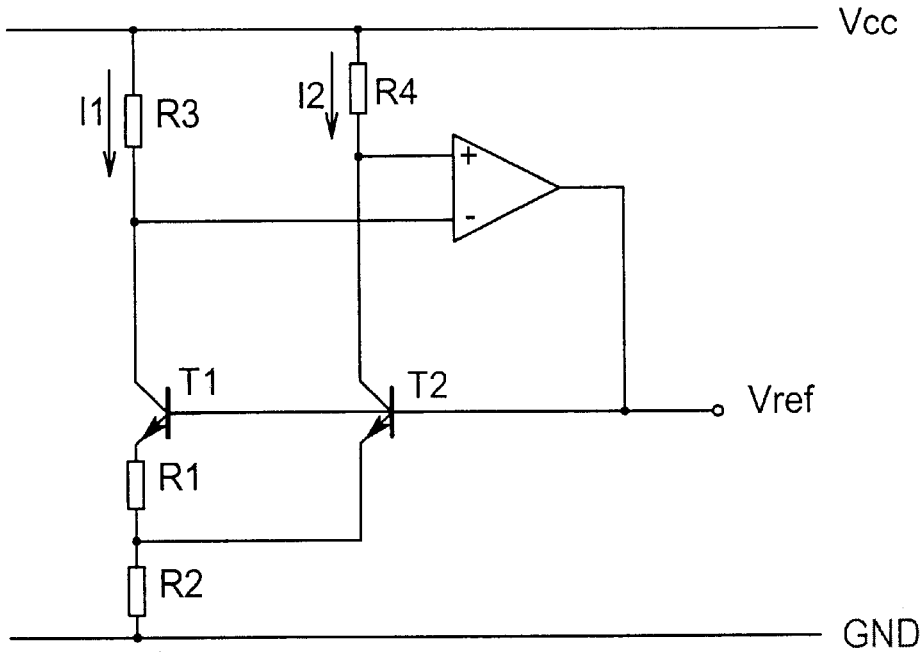
Fig. 1 (Prior Art)
FIG. 1 is a circuit diagram of a first prior art bandgap reference voltage generator circuit.

It is evident from this Table that the error in the bandgap reference voltage ΔVref resulting from the current error in the circuit in accordance with the invention as shown in FIG. 3 is smaller by a factor 1000 than that of the prior art bandgap reference voltage generator circuit as shown in FIG. 1. Accordingly, the bandgap reference voltage generator circuit in accordance with the invention features a substantially higher immunity to production component errors and mismatching between the components.

It is understood, of course, that the value of A=8 selected for the surface area ratio between the transistors is merely an example in which the two currents I1 and I2 are more or less equal and, of course, it is just as possible to design the circuit so that one transistor carries a higher current than the other.

However, the effect of the enhanced immunity to production component errors and mismatching between the components as described applies likewise to other values.

Figure 2:
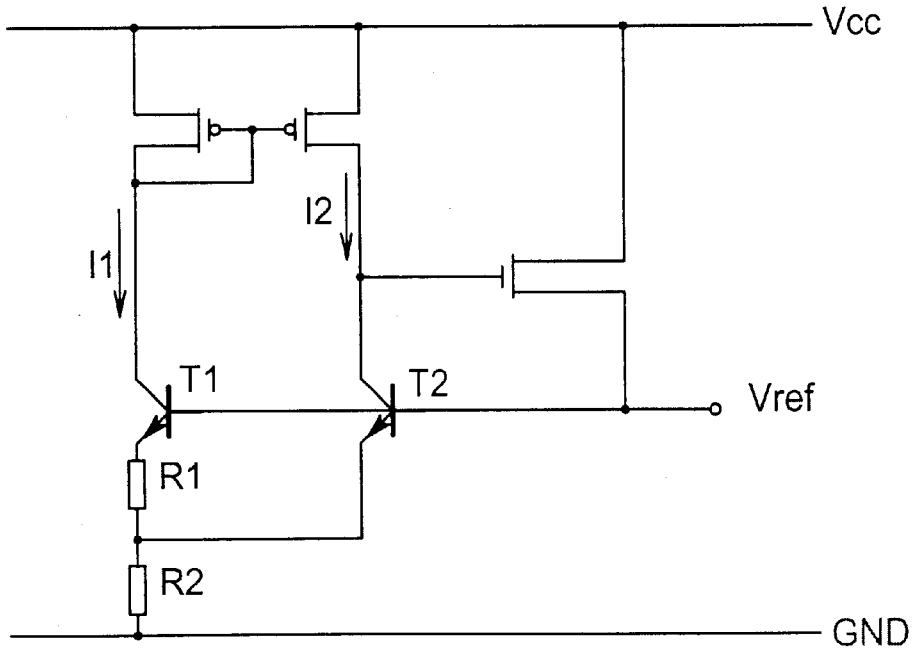
Fig. 2 (Prior Art)
FIG. 2 is a circuit diagram of a second prior art bandgap reference voltage generator circuit.

It will also be understood, of course, that the circuit in accordance with the invention can also be modified so that instead of an operational amplifier the current mirror as shown in FIG. 2 and a further transistor may be employed whose control input is connected to the collector of the second transistor and whose current path is connected to the bases of the two transistors.

It is also not necessarily so that different current densities of the two bipolar transistors can only be achieved by different emitter surface areas of the two transistors.

It is just as possible to provide instead of the current mirror as shown in FIG. 2 two additional resistors differing in resistance such as the resistors R3 and R4 as shown in FIG. 3, or two different current sources may be used, this likewise achieving differing current densities in the two transistors.

What is claimed is:

1. A bandgap reference voltage generator circuit comprising:

a first bipolar transistor (T1);

a second bipolar transistor (T2);

a first resistor (R1) connected so that the voltage drop across said first resistor corresponds to the difference between the base/emitter voltages of said first and second bipolar transistors (T1, T2) and which is located in the collector current path of said second transistor (T2);

a second resistor (R2) located in the collector current path of said first and second transistors (T1, T2), wherein the circuit said first transistor (T1) can be operated with a current density other than that of said second transistor (T2); and a control circuit having inputs being connected to the collectors (1,4) of said transistors (T1, T2) and that the collector currents of said transistors (T1, T2) are compared and a signal output at a terminal of said control circuit connected to the bases of the transistors wherein the bases (5, 6) of said transistors (T1, T2) being controlled so that a predefined ratio between the collector currents of said transistors (T1, T2) is set wherein said first resistor (R1) is connected between said base terminals (5,6) of said two transistors (T1, T2) and is, in addition, connected to the collector (4) of said second transistor (T2).

2. The bandgap reference voltage generator circuit as set forth in claim 1 wherein said control circuit includes two inputs and an output, the one input (8) of which is connected to the collector (1) of said first transistor (T1) and other input (9) is connected to the collector (4) of said second transistor (T2) and said output (10) being connected to the base (6) of said second transistor (T2) and said first resistor (R1) to the base (5) of said first transistor (T1).

3. The bandgap reference voltage generator circuit as set forth in claim 1 wherein said control circuit including a current mirror having two branches, the one current branch (I1) of which is connected to the collector (1) of said first transistor (T1) and other current branch (I2) is connected to the collector (4) of said second transistor (T2), and a further transistor whose one control input is connected to the collector (4) of said second transistor (T2) and whose current path is connected to the base (6) of said second transistor (T2) and via said first resistor (R1) to the base (5) of said first transistor (T1).

4. The bandgap reference voltage generator circuit in claim 1 wherein said first and second bipolar transistors (T1, T2) have different emitter surface areas, resulting in the differing current densities of said first and second bipolar transistors (T1, T2).

5. The bandgap reference voltage generator circuit in claim 1 wherein said first and second transistors are substantially identical and two additional resistors of differing resistance are provided, each of which is located in a collector current path of one of said first and second transistors (T1, T2) and is connected to that collector of said corresponding transistor, resulting in the different current densities of said two bipolar transistors (T1, T2).

6. The bandgap reference voltage generator circuit as in claim 1 wherein said first and second transistors are substantially identical and, in addition, two current sources differing in level are provided in said two collector current paths, resulting in the different current densities of said two bipolar transistors (T1, T2).

* * * * *